United States Patent [19]

Suzuki et al.

[11] 4,347,825

[45] Sep. 7, 1982

[54] FUEL INJECTION APPARATUS FOR AN INTERNAL COMBUSTION ENGINE

[75] Inventors: Suzuo Suzuki, Yokosuka; Yasuhiko Nakagawa, Kamakura; Hisamoto Aihara, Yokosuka; Yasuo Matsumoto, Yokohama, all of Japan

[73] Assignee: Nissan Motor Co., Ltd., Yokohama, Japan

[21] Appl. No.: 112,077

[22] Filed: Jan. 14, 1980

[30] Foreign Application Priority Data

Jan. 18, 1979 [JP] Japan ..... 54-4641

[51] Int. Cl.[3] ..... F02M 27/04

[52] U.S. Cl. ..... 123/537; 123/536

[58] Field of Search ..... 123/143 B, 536, 538, 123/297, 298, 537, 539

[56] References Cited

U.S. PATENT DOCUMENTS

| | | | |
|---|---|---|---|
| 3,266,783 | 8/1966 | Knight . | |
| 3,318,293 | 5/1967 | Hickling et al. | |
| 3,749,545 | 7/1973 | Velkoff | 123/537 |
| 4,034,728 | 7/1977 | Saufferer | 123/537 |
| 4,041,922 | 8/1977 | Abe et al. | 123/143 B |
| 4,051,826 | 10/1977 | Richards | 123/143 B |
| 4,082,070 | 4/1978 | Saufferer | 123/537 |
| 4,085,717 | 4/1978 | Willmann | 123/538 |
| 4,124,003 | 11/1978 | Abe et al. | 123/536 |
| 4,183,339 | 1/1980 | Nagaishi et al. . | |

FOREIGN PATENT DOCUMENTS

| | | |
|---|---|---|
| 2517682 | 4/1976 | Fed. Rep. of Germany . |
| 2449848 | 5/1976 | Fed. Rep. of Germany . |
| 2715222 | 5/1977 | Fed. Rep. of Germany . |
| 2746521 | 4/1978 | Fed. Rep. of Germany . |
| 52-89720 | 7/1977 | Japan . |
| 1512053 | 7/1975 | United Kingdom . |
| 1494681 | 12/1977 | United Kingdom . |
| 1519409 | 7/1978 | United Kingdom . |
| 1536675 | 12/1978 | United Kingdom . |
| 1552292 | 9/1979 | United Kingdom . |

*Primary Examiner*—Ronald H. Lazarus

*Attorney, Agent, or Firm*—Lane, Aitken, Kice & Kananen

[57] ABSTRACT

A fuel injection apparatus for an internal combustion engine has at least one fuel injection valve. An annular or ring-shaped electrode is mounted near the fuel injection valve to encircle the injected fuel. A high voltage generator produces an electric field between the electrode and the fuel injection valve as well as a surrounding wall which are both connected to the ground. Electrified fuel particles are finely atomized and prevented from attaching onto the surrounding wall to improve the operation, starting characteristic, and transient response of the engine.

10 Claims, 16 Drawing Figures

FUEL INJECTION APPARATUS FOR AN INTERNAL COMBUSTION ENGINE

BACKGROUND OF THE INVENTION

The present invention relates to a fuel injection apparatus for an internal combustion engine, and more particularly to an apparatus which electrifies injected fuel so as to promote atomization of the fuel into finely divided particles, and to prevent the fuel particles from attaching onto surrounding surfaces, e.g., an inside wall of a suction conduit.

In a conventional electronic controlled fuel injection apparatus for a multi-cylinder engine, a so-called single point injection system (SPI system) utilizes a single fuel injection valve which injects the fuel at a relatively low pressure of about 2 atm, so that injected fuel particles are not finely atomized. Thus, fuel injected from such injection valve tends to attach onto an inside wall of the suction conduit and a outside wall of suction valve, and relatively large portion of the injected fuel flows into the combustion chambers as liquid flow. Since the injected fuel cannot be distributed to each cylinder uniformly, problems occur as to inadequate operational stability, low engine output, starting difficulty at low temperature, and inadequate operational transient response.

To attain finely atomized fuel particles, fuel injection pressure may be increased. However, the fuel pump and fuel injection valve must be elaborated with an accompanying increase of the cost.

A conventional direct injection engine has fuel injection valves each of which injects fuel into each cylinder at high injection pressure, e.g., 100 atm. Fuel injected from such fuel injection valve is atomized into fine particles. However, the injected fuel reaches too far to the walls of cylinder, cylinder head and piston. Fuel attached onto the walls in a liquid state is difficult to perform complete combustion so that combustion efficiency is decreased and incomplete combustion hydrocarbon products tend to increase in the exhaust gas.

It is known that when liquid particles are electrified by high voltage, the particles tend to divide into smaller particles and the electrified particles tend to repulse from a substance of the same polarity. However, a simple and reliable device to electrify fuel particles is not known.

SUMMARY OF THE INVENTION

Accordingly, the object of the present invention is to provide a fuel injection apparatus for an internal combustion engine utilizing the high voltage electrification of fuel particles to divide injected fuel into fine particles at low injection pressure and to prevent fuel from attaching to surrounding walls.

A basic experiment of the present invention will be described with reference to FIG. 1.

Liquid, e.g. water or gasoline, is injected from a metallic nozzle 1 which is connected with the ground, toward an earth electrode 2 which is also connected with the ground. An annular or ring-shaped electrode 4 surrounds the injected liquid, which is arranged to be coaxial with the injection axis of the nozzle 1. A high voltage generator 3 applies high voltage, which is of positive potential, to the annular electrode 2. In the experiment, injected liquid particles change direction near the earth electrode 2 as shown in FIG. 1, and tend to divide into fine particles.

The experiment shows that the injected liquid is electrified to a negative potential by the electric field formed between the nozzle 1 and the annular electrode 4, so that a repulsive force is produced in the injected liquid to divide the liquid into fine particles. Further, an electric field 6 shown by dotted line in FIG. 1 is produced between the electrodes 2 and 4 so that the injected liquid particles 5 which are electrified to a negative potential are repulsed by the electrode 2 which is of the same polarity, and tend to move toward the annular electrode 4.

In the experiments, it was also found that by mixing a few percent of alcohol, which is more conductive than gasoline and Diesel oil, with the gasoline or oil, the phenomena became more remarkable.

Thus, in order to attain the above-mentioned advantages, the present invention provides a fuel injection apparatus for an internal combustion engine wherein use is made of an annular electrode which surrounds the injected fuel, and a high voltage generator which produces the repulsive force between the particles of the injected fuel.

According to one aspect of the present invention, there is provided a fuel injection apparatus for an internal combustion engine comprising a first high voltage generating means to electrify the fuel injected from a fuel injection valve, a second high voltage generating means to form an electric field within an injected fuel passage defined by a wall, and an electrode arranged in opposition to the injected fuel near the fuel injection valve and applied with the high voltage which is generated by said second high voltage generating means and has an opposite polarity to said electrified fuel, said wall defining said passage being electrified to the same polarity with said electrified fuel.

According to another aspect of the present invention, there is provided a fuel injection apparatus for an internal combustion engine comprising a fuel injection valve, an electrode mounted near the fuel injection valve and adapted to electrify the fuel injected from said fuel injection valve, and a high voltage generating means connected with said electrode, said high voltage generating means comprising a circuit for a conventional ignition system of the engine.

According to a still further aspect of the present invention, there is provided a fuel injection apparatus for an internal combustion engine comprising a fuel injection nozzle adapted to inject fuel into a combustion chamber of a cylinder of the engine, an electrode arranged in opposition to the injected fuel and disposed in front of the injection nozzle, a high voltage generating means adapted to apply high voltage between said electrode and the combustion chamber and the injection nozzle, the combustion chamber and the injection nozzle being connected with ground, and means to apply the high voltage to electrify the injected fuel only during the starting operation of the engine.

Some preferred embodiments of the present invention will be described in detail by referring to the drawings.

DETAILED DESCRIPTION OF THE EMBODIMENTS

Figure 2:
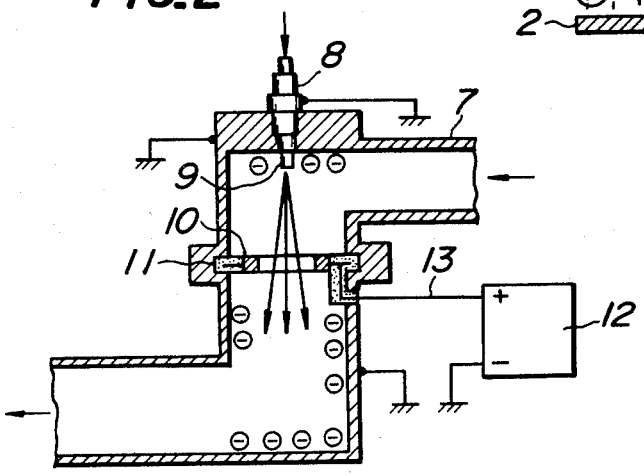
FIG. 2 is a schematic sectional view of a first embodiment of the present invention showing a portion of a suction conduit.

Referring now to FIG. 2, there is shown a fuel injection valve 8 mounted on a suction conduit 7 which has two perpendicularly bent portions. An injection nozzle 9 of the valve 8 lies on a center line of a middle portion of the suction conduit 7 located between the bent portions, and injects fuel along the flow direction of suction air in the middle portion. The fuel injection valve 8 itself is of a conventional type. The middle portion between the two bent portions has mounted on its inner wall through an insulating member 11 an annular electrode 10 through which passes the injected fuel. Metallic portions of the fuel injection valve 8 and the suction conduit 7 are electrically connected with ground, namely with an engine body or the vehicle body. There is provided a high voltage generator 12 for generating high voltage of about 1–30 kV, whose positive terminal is connected with the electrode 10 through a lead wire 13 which extends through the insulating member 11 while the negative terminal is connected with ground.

Figure 1:
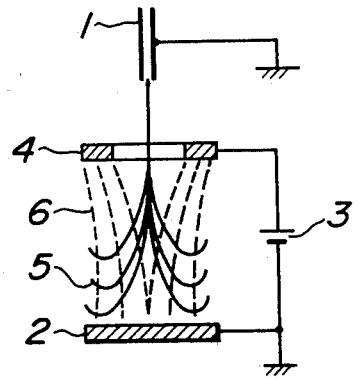
FIG. 1 is an illustration explaining a basic experiment of the present invention.

In the apparatus shown in FIG. 2, fuel which passes through the fuel injection valve 8 is electrified to a negative potential. As described with reference to FIG. 1, a repulsive force is produced in the fuel particles against each other, and the fuel particles are divided into smaller size when the fuel is injected from the injection valve 8. In the middle portion of the suction conduit 7, an electric field is produced between the electrode 10 and the wall of the suction conduit 7, so that fuel particles which are electrified to negative potential receive a repulsive force relative to the wall of the suction conduit 7. Consequently, fuel is prevented from attaching onto the inside surface of the suction conduit 7. As the fuel particles which are electrified to negative potential repulse each other, divergence of the fuel particles is augmented, and fuel mist distributes uniformly throughout the inside space of the suction conduit 7.

In the embodiment shown in FIG. 2, a positive high voltage is applied to the electrode 10. However, a negative high voltage may be applied thereto in order to obtain the same effect.

Figure 3:
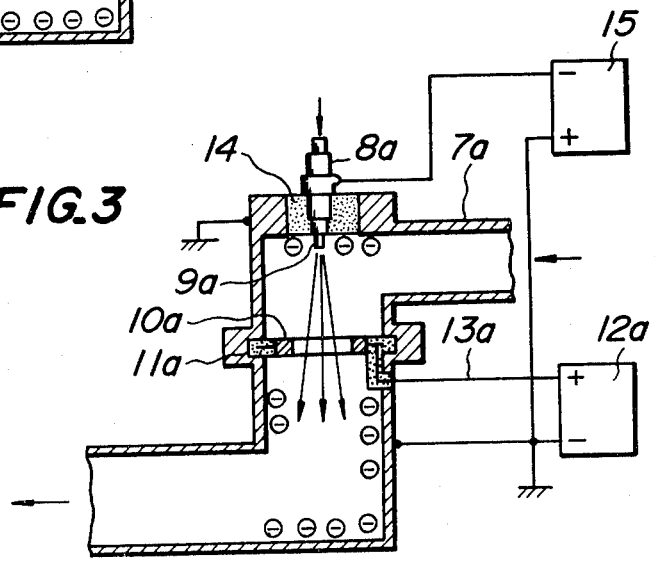
FIG. 3 is a schematic sectional view of a second embodiment of the present invention.

FIG. 3 shows a second embodiment of the present invention. A similar part or portion to that shown in FIG. 2 is designated by the same reference numeral attached with "a". The only difference lies in that the fuel injection valve 8*a* is insulated from the suction conduit 7*a* through an insulation member 14, and another high voltage generator 15 applies high voltage of a negative polarity to the fuel injection valve 8*a*. Thus, fuel injected through the fuel injection valve 8*a* is electrified more effectively than in the embodiment shown in FIG. 2.

Consequently, fuel is effectively divided, and divergence of the fuel mist is improved. Also, repulsive force of fuel relative to the wall of the suction conduit 7*a* is increased, so that fuel is more positively prevented from attaching onto the inside surface of the suction conduit 7*a*.

Figure 4:
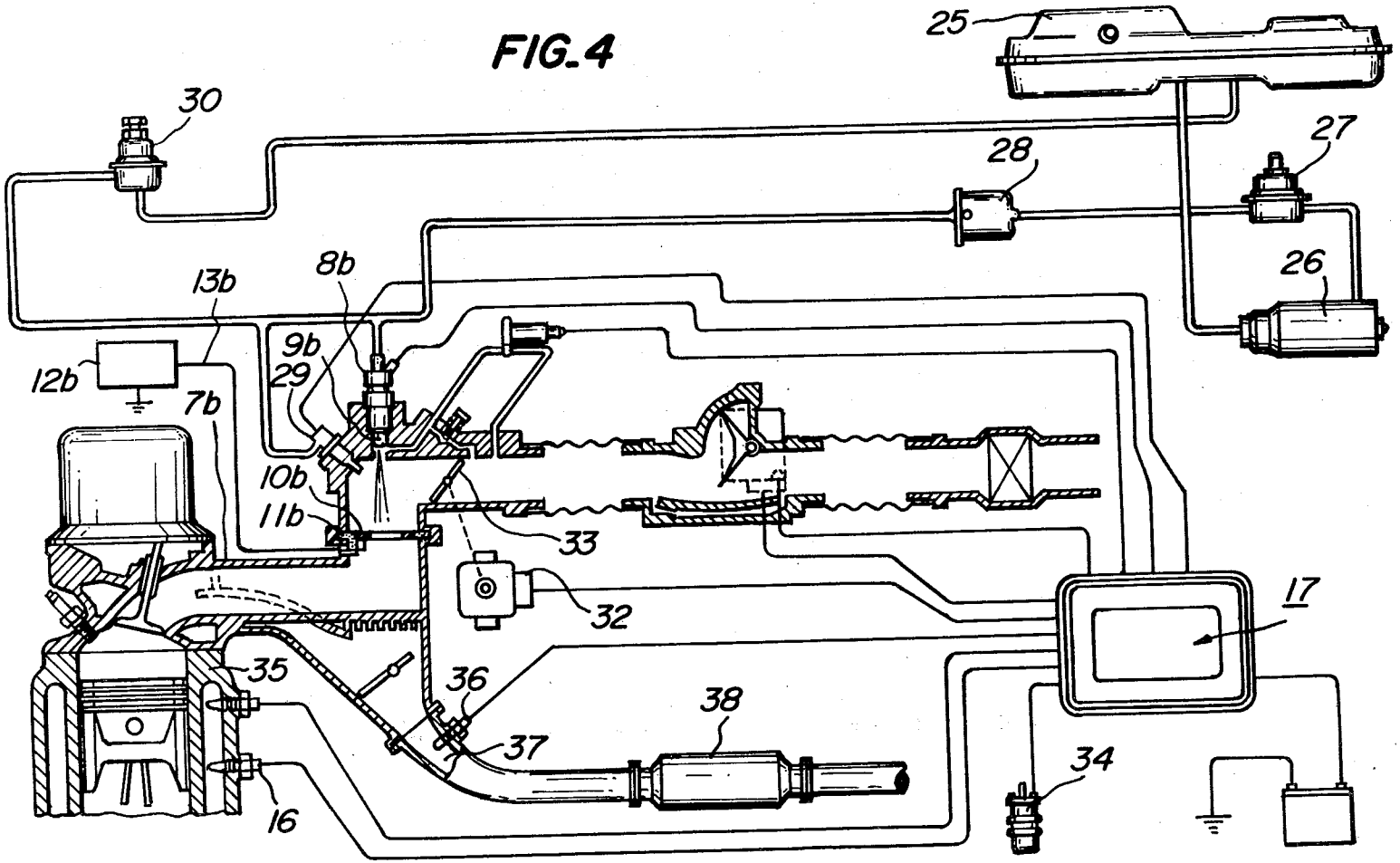
FIG. 4 is a schematic sectional view of a third embodiment of the present invention showing a fuel supply system and a control system of an engine.

FIG. 4 shows third embodiment of the present invention, in which the apparatus shown in FIG. 2 is applied to an internal combustion engine of a single point injection system. By this system, as stated previously, fuel for all the cylinders is injected through one fuel injection nozzle which is denoted by the numeral 9*b*.

The apparatus has a suction conduit 7*b*, a fuel injection valve 8*b* with the fuel injection nozzle 9*b*, an annular electrode 10*b*, an insulation member 11*b*, a high voltage generator 12*b* and a lead wire 13*b*, all being similar with those shown in FIG. 2.

Fuel from a fuel tank 25 is supplied by a fuel pump 26 through a fuel damper 27 and a filter 28 to the fuel injection valve 8*b* and to a cold start valve 29. A pressure regulator 30 regulates fuel pressure.

A control unit 17 receives signals representing operating conditions of the engine from an air flow sensor 31, a throttle sensor 32 which detects opening of a throttle valve 33, an engine rotation sensor 34 which detects an ignition signal of a distributor, and a water temperature sensor 16 which detects cooling water temperature of the cylinders 35. The control unit 17 processes the signals from the sensors and calculates optimum fuel quantity to be supplied through the fuel injection valve 8*b* and through the cold start valve 29. Also, air fuel ratio detected by an oxygen sensor 36 mounted to an exhaust conduit 37 is fed back to the control unit 17 which compensates the fuel injection quantity to obtain a stoichiometrical air fuel ratio to thereby maintain the maximum performance of a three elements catalizer 38 at a downstream portion of the exhaust conduit 37.

Fuel supplied into the suction conduit 7*b* is distributed uniformly in the suction conduit 7*b* and hence, in each of the cylinders, so that combustion can be effected efficiently, and an improved output efficiency of the engine can be attained. Also, as the fuel is prevented from attaching onto the inside surface of the suction conduit 7*b*, improved combustion and uniformity of the fuel mist distribution can be attained.

When the engine temperature is low, e.g. at the starting operation, fuel tends to attach on the inside surface of the suction conduit 7*b* because of the increased viscosity. Thus, when the engine temperature is low, the cooling water temperature sensor 16 supplies a signal to the control unit 17 indicating that the detected temperature is below a predetermined value. Then, the control unit 17 may apply an actuating signal to the high voltage generator 12*b*. In this case, high voltage is applied to the electrode 10*b* only when the engine temperature is low. This improves the starting characteristic of the engine.

Figure 5:
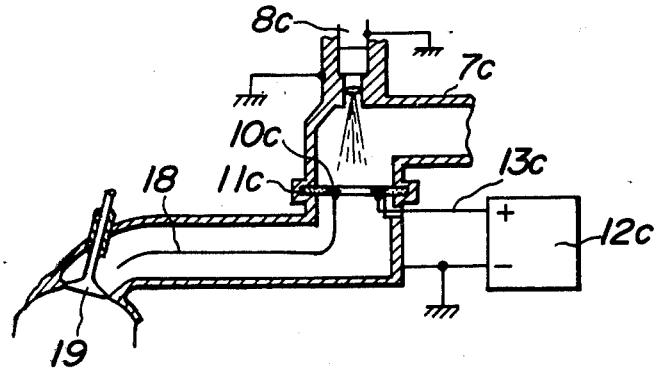
FIG. 5 is a schematic sectional view of a fourth embodiment of the present invention showing a portion of a suction conduit and a cylinder.

FIG. 5 shows a fourth embodiment of the present invention. As before, same reference numeral added with "c" shows a same or similar part or portion shown in FIG. 2. In this embodiment, the only difference is that a wire or ribbon electrode 18 is extended from the annular electrode 10*c* in the suction conduit 7*c* to a downstream position near a suction valve 19. Thus, a strong electric field is formed in the suction conduit 7*c* so that fuel particles are repulsed from the inside wall of the suction conduit 7*c* nearly all the way. Consequently, fuel is effectively prevented from attaching to the inside surface of the suction conduit 7*c* for a substantial length.

Figure 6:
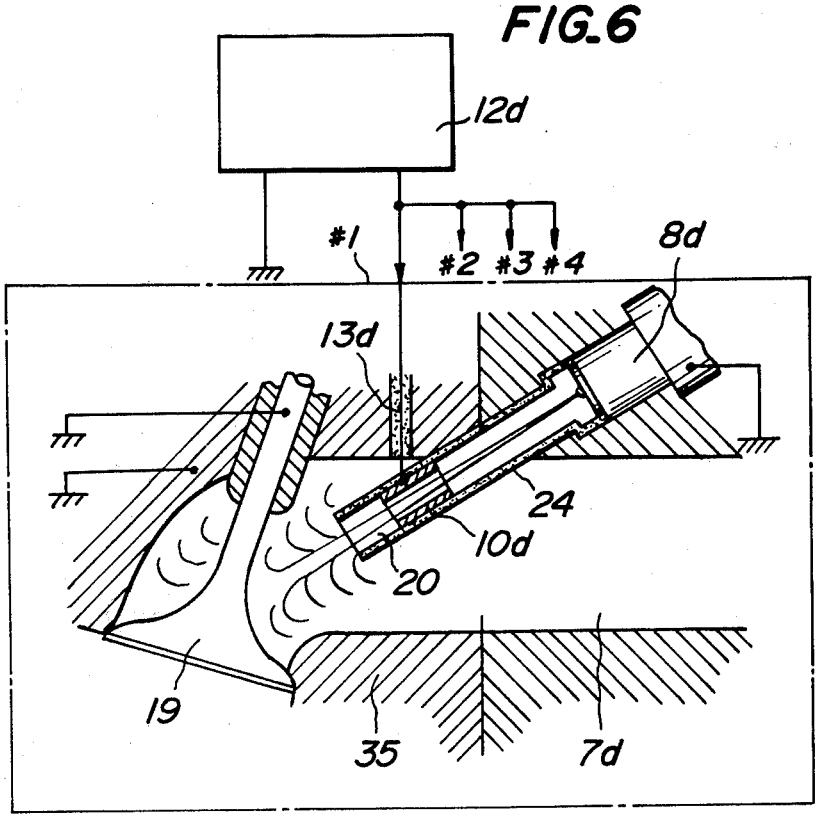
FIG. 6 is a schematic sectional view of a fifth embodiment of the present invention.

FIG. 6 shows a fifth embodiment of the present invention. The same reference numeral added with "d" shows a same or similar part or portion as is shown in FIG. 2. In this embodiment, the apparatus is for an electronic controlled fuel injection system which has a plurality of fuel injection nozzles each of which injects fuel to a suction port of each cylinder. In this case, the annular electrode 10*d* is placed along a fuel injection passage 20. To this end, a generally cylindrical insulating member 24 extends from the fuel injection valve 8*d* along the longitudinal axis of the valve 8*d*, and the electrode 10*d* is secured to the inner surface of the insulating member 24. The cylinder 35, the suction valve 19 and the fuel injection valve 8*d* are connected with ground. The high voltage generator 12*d* supplies high voltage to all the electrodes cooperating with all the cylinders #1 (35), #2, #3 and #4, in response to the fuel injection trigger signal applied thereto. Thus, fuel is prevented from attaching to the suction conduit 7*d*, to the cylinder 35 and also to the suction valve 19. In the embodiment shown, the insulating member 24 is projected far from the inside wall of the suction conduit 7*d*. However, the insulating member 24 and the annular electrode 10*d* may be short enough such that the free ends barely project from the inside wall of the suction conduit 7*d*.

The high voltage generator 12*d* may be actuated only when the fuel injection valve 8*d* is actuated, to be more fully described hereinafter.

Figure 7:
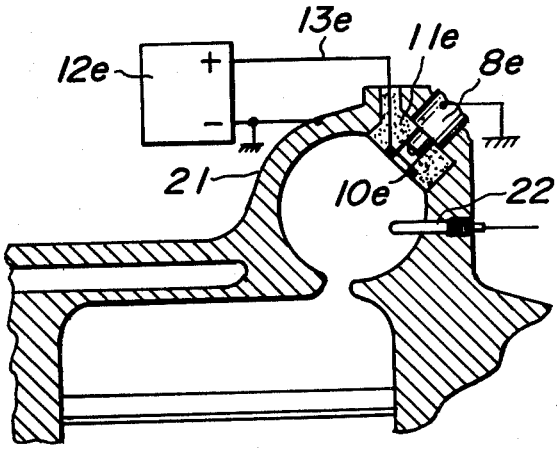
FIG. 7 is a schematic sectional view of a sixth embodiment of the present invention showing a portion of a cylinder of a Diesel engine.

FIG. 7 shows a sixth embodiment of the present invention which is applied to the fuel injection nozzle of a Diesel engine. As before, the same reference numeral added with "e" shows a same or similar part or portion as is shown in FIG. 2. In this embodiment, a fuel injection nozzle 8*e* injects fuel into a precombustion chamber 21. Along the axis of the nozzle 8*e*, the annular electrode 10*e* is mounted through the insulation member 11*e* to the chamber 21, such that the electrode 10*e* concentrically encircles the injected fuel. The fuel injection nozzle 8*e*, the precombustion chamber wall and a glow plug 22 are connected with ground. The high voltage generator 12*e* supplies a positive polarity high voltage to the electrode 10*e* through the lead wire 13*e*.

As the injected fuel is prevented from attaching onto the inside wall of the chamber 21 and outside wall of the glow plug 22, complete combustion of the fuel in the cylinders is ensured. Further, production of incompletely combusted hydrocarbons is suppressed. Although the Diesel engine shown in FIG. 7 has the precombustion chamber 21, the present invention can be applied to direct injection type Diesel engines.

Figure 8:
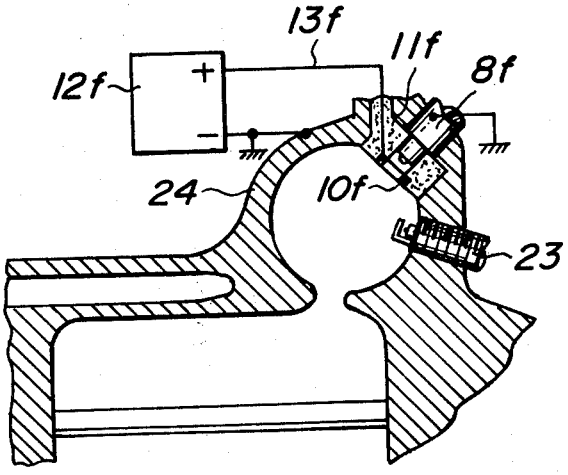
FIG. 8 is a schematic sectional view of a seventh embodiment of the present invention showing a portion of a cylinder having a precombustion chamber.

FIG. 8 shows a seventh embodiment of the present invention which is applied to a fuel injection valve of a gasoline engine with precombustion chambers. The same reference numeral added with "f" shows a same or similar part or portion as is shown in FIG. 2. The fuel injection valve 8*f* and an ignition plug 23 are mounted to the wall of a precombustion chamber 24 of a gasoline engine. The electrode 10*f* connected with positive terminal of the high voltage generator 12*f* is mounted to the chamber 24 near the injection valve 8*f*, such that the injected fuel is concentrically encircled by the electrode 10*f*.

As the injected fuel is prevented from attaching to the inside wall of the chamber 24, incompletely combusted hydrocarbons are not produced.

Figure 9:
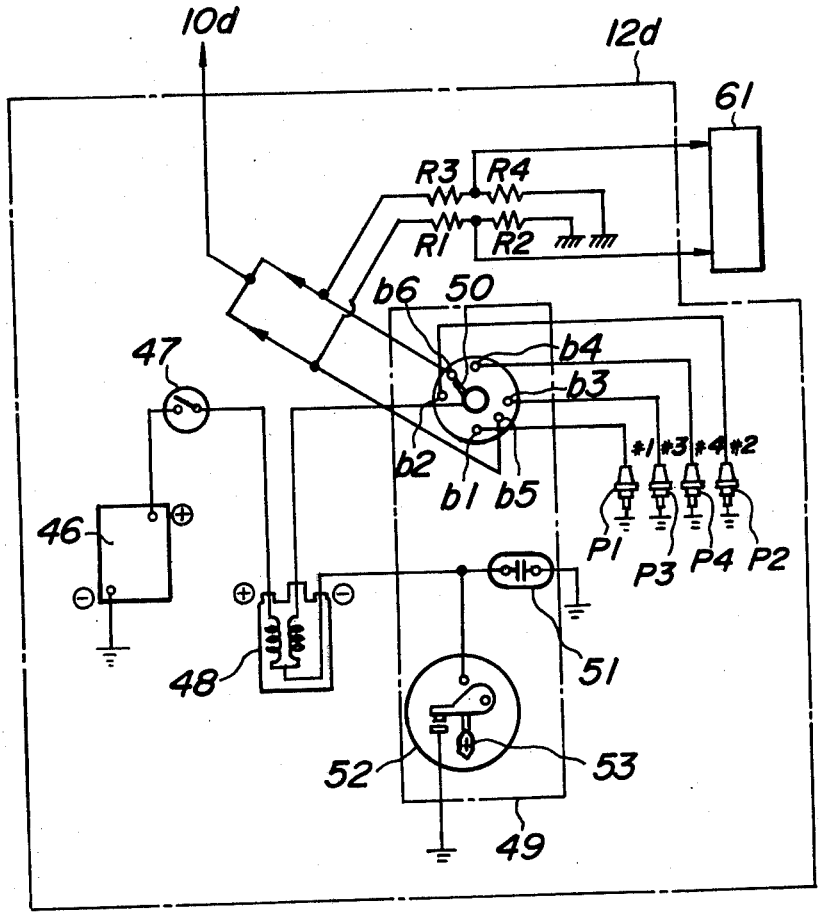
FIG. 9 is a circuit diagram of the high voltage generator shown in FIG. 6.

FIG. 9 shows one embodiment of the high voltage generator 12*d* shown in FIG. 6, which is a modification of a conventional ignition apparatus. A battery 46 supplies electric power through an ignition switch 47 to an ignition coil 48 which supplies high voltage through a distributor 49 to spark plugs P1, P3, P4, P2 of cylinders #1, #3, #4, #2 in this sequence.

The distributor 49 has a rotary head 50, a capacitor 51, an interrupter 52 and a cam 53 which drives the interrupter 52. The distributor 49 has new diagonally arranged electrodes b5 and b6 besides ordinary electrodes b1 to b4 which are connected with the spark plugs P1 to P4, respectively. The cam 53 is of hexagonal configuration to correspond with the new electrodes b5 and b6.

When the rotary head 50 and the cam 53 rotate integrally and synchronously with the crank shaft rotation, the interrupter 52 opens and closes to induce high voltage in the ignition coil 48, so that a high voltage is supplied sequentially to the electrodes b1, b5, b3, b4, b6, and b2.

The high voltage is applied to plugs P1 to P4 through the electrodes b1 to b4, and to the annular electrodes 10*d* of the cylinders #1 to #4 through the electrodes b5 and b6. Further, the high voltage applied through the electrodes b5 and b6 is divided by resistors R1 to R4 and is applied to control unit 61 to be used as a fuel injection trigger signal which decides the starting time point of the valve opening operation of the fuel injection valve 8*d*. Thus, high voltage is applied to the electrode 10*d* when fuel is injected from the fuel injection valve 8*d*. As the actuation of the electrode 10*d* is synchronized with the fuel injection of the fuel injection valve 8*d*, fuel is effectively electrified, and the repulsive force of fuel relative to the inside wall of the suction port 35 and the outside wall of the suction valve 19 effectively prevents fuel from attaching to the walls. Thus, a substantial part of the injected fuel is introduced into the combustion chamber of the cylinder as finely divided particles so that the combustion property and transient response of the engine are improved.

Figure 10:
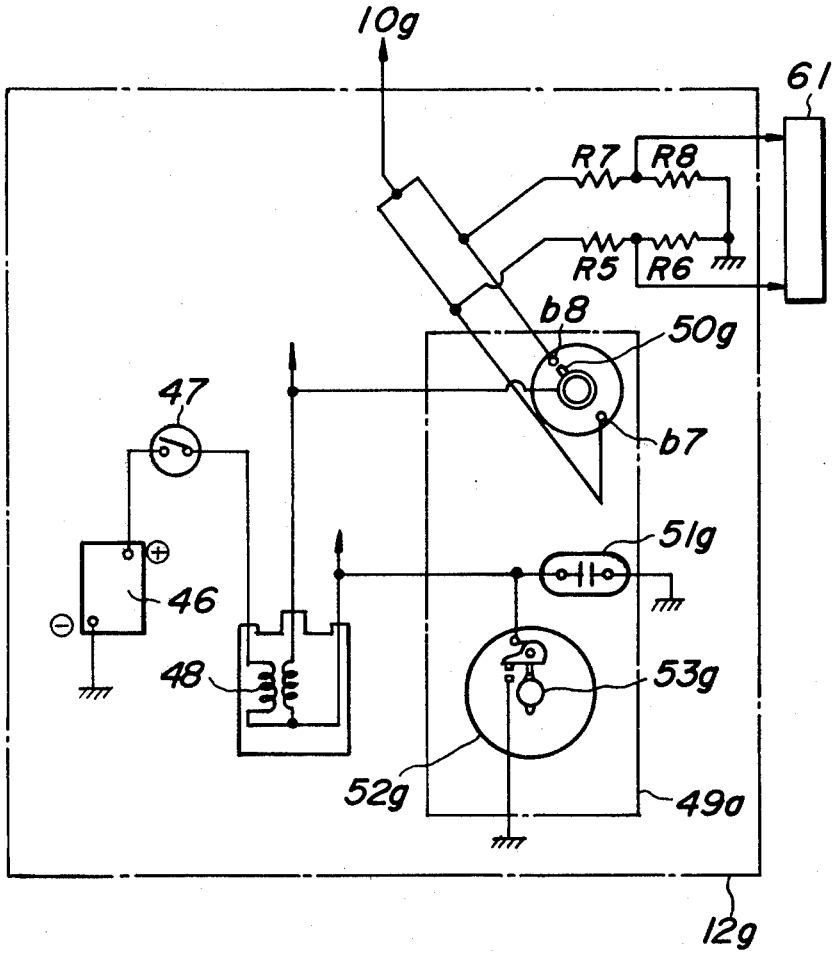
FIG. 10 is a circuit diagram of a second embodiment of the high voltage generator.

FIG. 10 shows another embodiment of the high voltage generator. The same reference numeral added with "g" shows a same or similar part or portion as is shown in FIG. 9. The high voltage generator has a conventional ignition apparatus including the battery 46, ignition switch 47, the ignition coil 48 and a distributor 49*g* which is used to generate the high voltage which is applied to the electrodes 10*g* only.

The distributor 49*g* is connected in parallel with a conventional distributor, not shown, with respect to the ignition coil 48, and has a rotor head 50*g*, a capacitor 51*g*, and interrupter 52*g* and a cam 53*g*. The distributor 49*g* has diametrically arranged distributing electrodes b7 and b8 which are intermittently conducted with the rotor head 50*g*. The cam 53*g* which drives the interrupter 52*g* corresponding to the electrodes b7 and b8 has only two opposed projections.

When the rotor head 50*g* and the cam 53*g* rotate integrally and synchronously with the rotation of a crankshaft, high voltage is induced in the ignition coil 48, and is applied to the electrodes 10*g* of the cylinders. The high voltage is divided by resistors R5 to R8, and is applied to a control unit 61 to be used as a fuel injection trigger signal. The feature of the device 12*g* is similar with that shown in FIG. 9.

Figure 11:
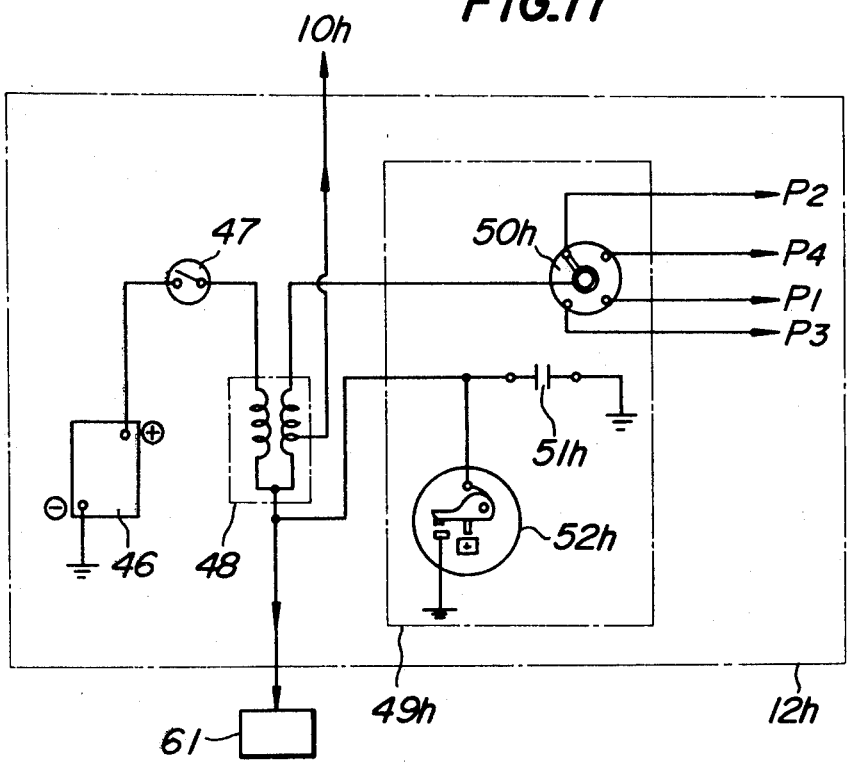
FIG. 11 is a circuit diagram of a third embodiment of the high voltage generator.

FIG. 11 shows a further embodiment of the high voltage generator. The high voltage generator has a conventional battery 46, an ignition switch 47, an ignition coil 48 and a conventional distributor 49*h* including a rotor head 50*h*, a capacitor 51*h* and an interrupter 52*h*.

An intermediate portion of a secondary winding of the ignition coil 48 and the lead wires from the electrodes 10*h* are connected with each other to supply the high voltage whenever the high voltage is induced in the ignition coil 48. Further, a junction between the primary and secondary windings of the ignition coil 48 applies the fuel injection trigger signal to the control unit 61.

Thus, the high voltage is applied to all the electrodes 10*h* whenever a spark plug is ignited. As the high voltage only acts as potential, electric power consumption is relatively low. Even when the fuel injection valve 8*d* is not actuated, some part of the fuel remains in the associated suction cnduit 7*d* (FIG. 6), so that by electrifying the remaining fuel, fuel is further prevented from attaching to the wall of the suction port 7*d*. Consequently, the combustion and transient response of the engine are further improved.

Figure 12:
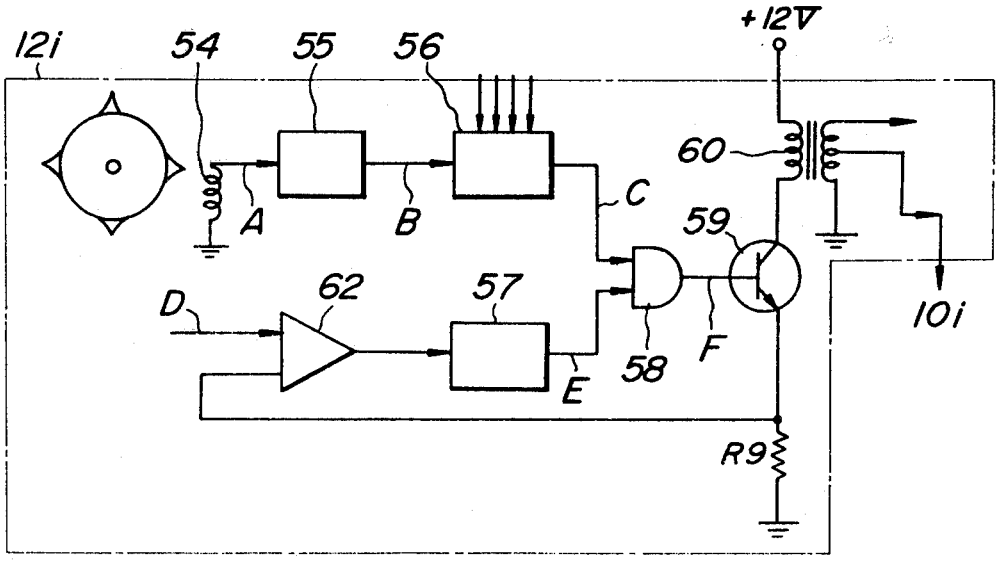
FIG. 12 is a circuit diagram of a fourth embodiment of the high voltage generator.

FIG. 12 shows still another embodiment of high voltage generator. The high voltage generator 12*i* has an electromagnetic pick-up 54 which produces an output signal having a waveform shown as A in FIG. 14. The output voltage changes from negative to positive potential at the time of ignition. A rectifier circuit 55 supplies a high level signal shown as B in FIG. 14 only when the output of the pick-up 54 is positive potential.

Figure 14:
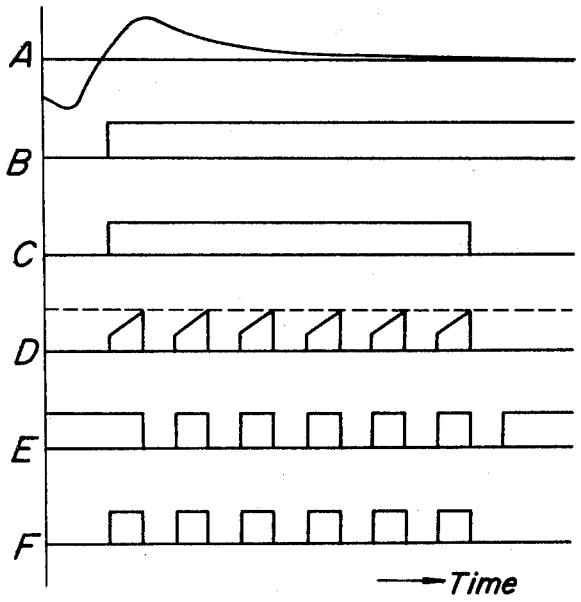
FIG. 14 is a diagram showing waveforms of output signals from the circuits shown in FIG. 12.

A voltage application period control circuit 56 supplies a high level output signal shown at C in FIG. 14 only when the high voltage is to be applied to an electrode 10*i*, based on the output of the rectifier circuit 55 and signals applied thereto indicating the operation conditions of an engine as shown by arrows in FIG. 12.

A monostable multivibrator 57 normally supplies a high level output signal, and a low level output signal for a predetermined period shown at E in FIG. 14 when a positive potential pulse is applied.

A drive gate 58 opens only when output signals of the control circuit 56 and the multivibrator 57 are at a high level and applies a high level signal shown at F in FIG. 14 to the base of a transistor 59.

A primary winding of an ignition coil 60 is connected with a battery at one end, and with ground through the transistor 59 and a resistor R9 at the other end. The secondary winding of the ignition coil 60 is connected with a distributor, not shown; which distributes the high voltage to the spark plugs, not shown, and to the electrode 10*i*.

When the base of the transistor 59 is applied with a high level signal from the drive gate 58, the collector and emitter of the transistor 59 are conducted with each other so that a voltage is produced across the resistor R9. The voltage across the resistor R9 is applied to a comparator 62 which supplies the high level output signal to the multivibrator 57 when the voltage becomes higher than a reference voltage level shown by dotted line of D in FIG. 14, which determines the peak current.

In operation, since the multivibrator 57 initially supplies a high level output signal, when the high level signal is applied to the drive gate 58 from the control circuit 56, the drive gate 58 is opened instantaneously and supplies a high level output signal to the base of the transistor 59. Thus, the transistor is conductive and positive potential is produced across the resistor R9. The positive potential increases and exceeds the reference voltage which sets the peak current.

Then, the comparator 63 supplies a high level output signal to the multivibrator 57 to change its output to the low level from the high level; the low level being maintained for a predetermined period. Thus, the drive gate 58 shuts the gate and applies a low level signal so that the transistor 59 becomes non-conductive between the collector and the emitter.

After the predetermined period, the monostable multivibrator 57 supplies a high level output signal, and the transistor 59 becomes conductive. The cycle is repeated.

Consequently, when the control circuit 56 supplies a high level signal, the transistor becomes conductive intermittently between the collector and the emitter thereof, and the current which is supplied to the primary winding of the ignition coil 60 is intermittently switched on and off. Corresponding to the switchings of the primary winding, a high voltage is induced in the secondary winding of the ignition coil and is supplied to the spark plugs through the distributor and to the electrode 10*i*.

Figure 15:
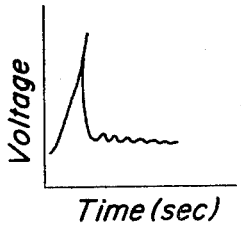
FIG. 15 is a diagram showing the waveform of the signal applied to electrodes shown in FIGS. 9 to 11.
Figure 16:
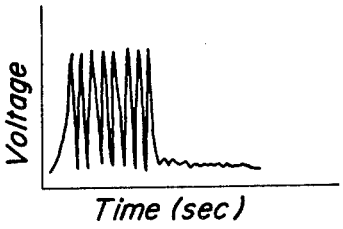
FIG. 16 is a diagram showing the waveform of the signal applied to the electrode shown in FIG. 12.

The high voltage generators 12*d*, 12 *g* and 12*h* shown in FIGS. 9 to 11 supply the high voltage signal whose waveform is as shown in FIG. 15. High voltage supplied by the high voltage generator 12*i* to the electrode 10*i* has a waveform as shown in FIG. 16. As shown, throughout the period in which the control circuit 56 supplies a high level signal, high voltage is intermittently applied to the electrode 10*c*, so that the injected fuel is electrified more effectively to prevent the fuel from attaching onto the inside wall of the suction conduit and outside wall of the suction valve. Thus, the combustion property and transient response of the engine are improved.

Figure 13:
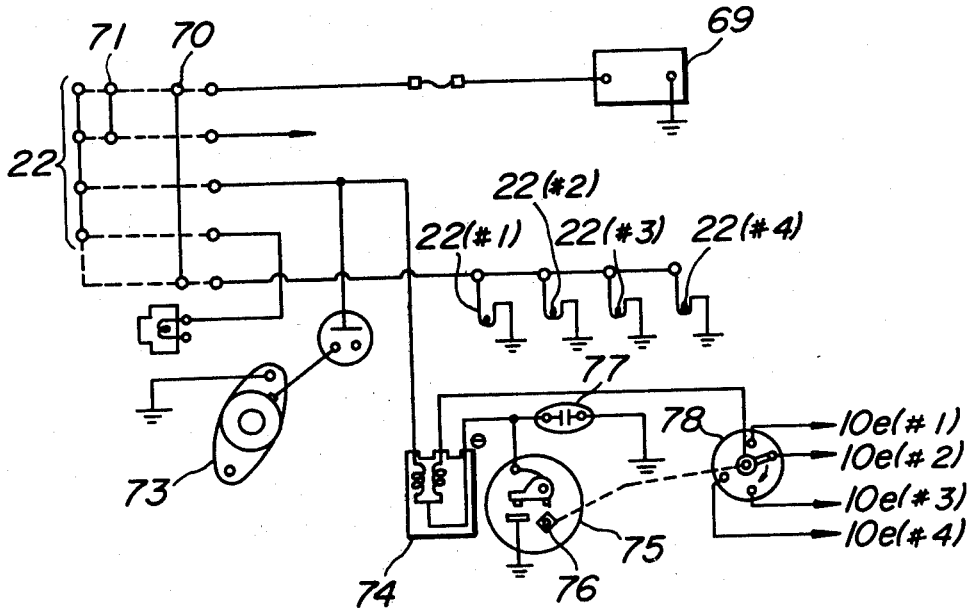
FIG. 13 is a circuit diagram of a starting system of the engine shown in FIG. 7.

FIG. 13 shows an electric circuit for the Diesel engine shown in FIG. 7 having the precombustion chamber 21, the glow plug 22 and the electrode 10*e* for each cylinder. The electric circuit includes a conventional battery 69, a glow contact 70, a starter contact 71, an ignition key switch contact 72, a starter 73, a lamp 68 and glow plugs 22 (#1, #2, #3 and #4) to constitute conventional starting circuit for Diesel engine.

The high voltage generator 12*e* shown in FIG. 7 includes an ingition coil 74, an interrupter 75, a cam 76 to open and close the interrupter 75, a capacitor 77 and a distributor 78. The elements and connection may be similar with those in the ignition circuit of a four cylinders gasoline engine. In place of spark plugs, annular electrodes 10*e* for each cylinder are supplied with high voltage synchronously with the fuel injection.

In the embodiment shown, current to be supplied to the starter 73 is branched and supplied to the ignition coil 74. Thus, the ignition coil 74 is energized only when the starter 73 is actuated to start the engine.

In operation, when a starter switch is actuated, the starter contact 71 is closed and the starter 73 is actuated. Thus, the ignition coil 74 is energized. As the engine begins to rotate, cooperation of the interrupter 75 and the cam 76 produces high voltage in the ignition coil 74 as in conventional ignition system for spark plugs, and the distributor 78 supplies high voltage to the annular electrode 10*e* just when the fuel injection valve 8*e* shown in FIG. 7 injects fuel into the precombustion chamber 21. The high voltage generator 12*e* shown in FIG. 13 operates only when the starter 73 is actuated. Thus, the injected fuel is prevented from attaching onto the inner wall of the chamber 21 which is still cold. Consequently, the starting characteristic of the Diesel engine is remarkably improved. When the engine is started and the starter 73 is deenergized, the ignition coil 74 is also deenergized.

It will be appreciated that, by supplying high voltage potential from the annular electrode and electrifying fuel just after being injected from the fuel injection valve, fuel is finely divided and distributes uniformly in the injected space without attaching to the surrounding wall and elements. Thus, fuel combustion property and hence, output efficiency of the engine is improved, and harmful incomplete combustion products is suppressed.

Also, even when high voltage is supplied to the annular electrode during the starting operation only, fuel is finely divided and uniformly distributed so that starting characteristic is remarkably improved.

When highly conductive fuel, e.g. alcohol, is added more than a few percent to gasoline or Diesel fuel, conductivity of fuel can be increased to be more easily electrified, so that the effect of the present invention is further improved.

The high voltage generator can be made simply by utilizing conventional ignition system which is used to ignite spark plugs. The ignition system may be modified to supply high voltage potential to the annular electrodes. As conventional ignition system is cheap and reliable, the high voltage generator according to the invention is also cheap and reliable.

What is claimed is:

1. A fuel injection apparatus for an internal combustion engine, wherein fuel is injected from an injection valve into a space defined by a wall of a fuel passage, comprising an electrode arranged in opposition to the injected fuel near the injection valve, and electrically insulated from the injection valve and the wall; first means for applying to the injection valve a first voltage; second means for applying to the electrode a second voltage; third means for applying to the wall a third voltage; the first, second and third voltages forming a high voltage electric field within the space, by which the injected fuel is electrified to have a polarity which is opposite to that of the electrode, and thus electrified fuel tends to be repulsed by the wall, characterized in that the third means consists of a connection between the wall and the ground, and that the electrode consists of a ring and a wire or ribbon connected with the ring and extending downstream from the ring within and along the fuel passage.

2. An apparatus as claimed in claim 1, characterized in that at least one of the first and second means is controlled by a controlling circuit including a sensor for detecting at least one surrounding temperature, such as the engine temperature or the suction air temperature, and means to operate said at least one of the first and second means only when said detected temperature is below a predetermined value.

3. An apparatus as claimed in claim 1, in which the fuel injection valve is electrically insulated from the wall, characterized in that the first and second means consist of a single voltage generating device having positive and negative terminals, one of which being connected to the electrode, and the other of which being connected to the wall.

4. An apparatus as claimed in claim 1, characterized in that the first means consists of a connection between the injection valve and the ground.

5. An apparatus as claimed in claim 1, characterized in that the fuel is mixed with alcohol.

6. An apparatus as claimed in claim 1, characterized in that at least one of the first and second means includes a high voltage circuit of an ignition system of the engine, and contact means connected between ignition terminals of an ignition distributor of the ignition system.

7. An apparatus as claimed in claim 1, characterized in that at least one of the first and second means includes a high voltage circuit of an ignition system of the engine, and a terminal connected to an intermediate portion of a secondary winding of an ignition coil of the ignition system.

8. An apparatus as claimed in claim 1, characterized in that at least one of the first and second means includes a high voltage circuit of an ignition system of the engine, and contact means driven by a common drive shaft for ignition distributor contacts of the ignition system.

9. An apparatus as claimed in claim 8, characterized by circuit means for supplying a signal to drive the fuel injection valve based on a high voltage signal produced by the contact means.

10. An apparatus as claimed in claim 1, characterized in that at least one of the first and second means includes a high voltage circuit of an ignition system of the engine, and circuit means which controls application of at least the respective one of the first and second voltages in response to an operating condition of the engine.

* * * * *